US006302010B1

(12) United States Patent
Holler

(10) Patent No.: US 6,302,010 B1
(45) Date of Patent: Oct. 16, 2001

(54) UTILITY VEHICLE FOR RESCUE AND DEFENSE

(76) Inventor: Christopher A. Holler, 2449 via Sienna Ave., Winter Park, FL (US) 32789

( * ) Notice: Subject to any disclaimer, the term of this patent is extended or adjusted under 35 U.S.C. 154(b) by 0 days.

(21) Appl. No.: 09/384,452

(22) Filed: Aug. 27, 1999

Related U.S. Application Data

(60) Provisional application No. 60/098,151, filed on Aug. 27, 1998, now abandoned.

(51) Int. Cl.[7] ..... F41H 5/26

(52) U.S. Cl. ..... 89/36.08; 296/24.1; 296/219; 296/220.01; 296/216.03; 296/223

(58) Field of Search ..... 89/36.08; 296/24.1, 296/219, 220.01, 222, 216.03, 223

(56) References Cited

U.S. PATENT DOCUMENTS

| | | | |
|---|---|---|---|
| D. 250,458 | 12/1978 | Bauer | D12/12 |
| D. 250,942 | 1/1979 | Appelblatt | D12/12 |
| D. 256,005 | 7/1980 | Bauer | D12/12 |

(List continued on next page.)

FOREIGN PATENT DOCUMENTS

19899 * of 1913 (GB) ..... 89/36.08

OTHER PUBLICATIONS

Garret; Breath Easier With Garret's EC/NBC Protection Systems; 8 pages, Jun. 1984.* www.hummer.com/civilian/photo/content.html, 1 page provided, Aug. 17, 1998.

www.hummer.com/industrial/photo/4.html, 1 page provided, Aug. 17, 1998.

www.hummer.com/industrial/photo/12.html, 1 page provided, Aug. 17, 1998.

www.hummer.com/industrial/info/info2v.html, 1 page provided, Aug. 17, 1998.

www.hummernet.com/pub/k2/hummer/humfirer.htm, 2 pages provided, Aug. 17, 1998.

www.firstdefense.com/html/default_vehicle_armor.htm, considered pp. 1–18 as provided, Aug. 11, 1998.

www.armormax.com/vehicle.htm, considered pp. 1–4 as provided, Aug. 11, 1998.

www.armormax.com/prices.htm, considered pp. 1–3 as provided, Aug. 11, 1998.

www.beverlyhillsarmor.com/html/body_hummer.html, 1 page provided, Aug. 11, 1998.

*Primary Examiner*—Stephen M. Johnson
(74) *Attorney, Agent, or Firm*—Greenberg Traurig, LLP; Anthony R. Barkume

(57) ABSTRACT

A multipurpose armored utility vehicle based on a civilian production base vehicle is configured to be used in hostile and dangerous police related missions. The vehicle comprises an armored drivers compartment and a rear mounted armored utility compartment comprising a plurality of view ports, gun ports, entry means and a roof mounted hatch with side protection where the vehicle can be used in rescue, and offensive and defensive modes of operation under fire.

18 Claims, 10 Drawing Sheets

U.S. PATENT DOCUMENTS

| | | | | |
|---|---|---|---|---|
| D. 256,225 | | 8/1980 | Bauer | D12/12 |
| D. 266,063 | | 9/1982 | Bemiss | D12/12 |
| D. 266,234 | | 9/1982 | Colwell | D12/12 |
| D. 267,001 | | 11/1982 | LeBlanc | D12/12 |
| D. 269,418 | | 6/1983 | Appelblatt et al. | D12/12 |
| D. 289,389 | | 4/1987 | Picard | D12/12 |
| D. 308,187 | | 5/1990 | Ottevaere et al. | D12/12 |
| D. 315,535 | | 3/1991 | Lockhart | D12/12 |
| D. 323,305 | | 1/1992 | Smith | D12/12 |
| 1,747,142 | * | 2/1930 | Campbell | 89/36.08 |
| 2,551,239 | * | 5/1951 | Bond | 296/223 |
| 4,132,446 | * | 1/1979 | Bauer | 296/155 |
| 4,158,986 | | 6/1979 | Appelblatt et al. | 89/36.08 |
| 4,280,393 | | 7/1981 | Giraud et al. | 89/36.08 |
| 4,316,404 | | 2/1982 | Medlin | 89/36.08 |
| 4,326,445 | | 4/1982 | Bemiss . | |
| 4,492,282 | | 1/1985 | Appelblatt et al. | 89/36.08 |
| 4,667,565 | | 5/1987 | Anderson | 89/36.08 |
| 4,677,896 | | 7/1987 | Litvinoff | 89/36.08 |
| 4,842,326 | | 6/1989 | DiVito | 296/196 |
| 4,919,477 | * | 4/1990 | Bingham et al. | 296/24.1 |
| 5,220,127 | | 6/1993 | Tiomkin et al. | 89/36.14 |
| 5,490,314 | | 2/1996 | Riddle | 29/426.2 |
| 5,573,300 | | 11/1996 | Simmons | 296/197 |

* cited by examiner

UTILITY VEHICLE FOR RESCUE AND DEFENSE

This application claims priority from the co-pending provisional application Ser. No. 60/098,151 filed on Aug. 27, 1998 entitled MODIFIED UTILITY VEHICLE FOR RESCUE AND DEFENSE now abandoned.

BACKGROUND OF THE INVENTION

Vehicles used in law enforcement, rescue or military operations historically have been manufactured to perform in a specific role, limiting the capabilities of the vehicle to those addressing the requirements of that role. Tanks for example, are used offensively to attack enemies and advance position in the field. They are built with features that allow them to advance with fortitude through a hostile environment consisting of unfriendly weapon fire and difficult terrain. Tanks and other offensive vehicles have features such as gun ports, missile launcher and heavy armor protection. Tanks are specifically built on specialized platforms and have limited access entry locations and have limited area inside the body for transporting personnel other than the vehicle crew. Their role does not allow the tank to take on or easily perform other functions such as those required of a personnel carrier or a rescue vehicle.

Tanks and other specialized equipment require a support team consisting of highly trained technicians to maintain and service the vehicle. Specialized support equipment and tools are required to keep the vehicle operational. The costs associated with this support infrastructure are significant.

In contrast to tanks and the like, rescue vehicles need to be able to accommodate the transport of a crew from one location to another in order to facilitate the recovery of injured persons. Large open areas are required inside the vehicle in order to expeditiously move people and equipment from inside to outside the vehicle. Features such as large doors and flat level surfaces, suitable to fit one or several stretchers, are necessary for the easy movement of injured people into and out of the vehicle. Vehicles used in this role are not typically used in offensive operations but as backup support vehicles to follow offensive vehicles and recover casualties. The nature of the role the rescue vehicle performs, precludes the use of features such as gun ports, exterior mounted handholds, heavy armor, and escape or weapon station hatches. Rescue vehicles may be made on production truck bodies without the need for special modification beyond the rear compartment requirements. Rescue vehicles do not have full armor and do not have provisions for self-defense or use in standalone offensive applications.

It is the intent of this invention to provide an enhanced vehicle which integrates and extends the capabilities from these diverse vehicles into a common platform in order to fulfill several needs simultaneously. A police force has these multi-function requirements yet cannot usually afford to have many different highly specialized vehicles at their disposal. The related dedicated technical staff and infrastructure required to maintain highly specialized vehicles cannot be supported under civilian budgetary constraints.

The escalation of terrorism and violent activities in urban, suburban, and rural areas, have stressed the capabilities of police forces. The complex nature of hostage and under-fire situations have developed a new need for a vehicle which can penetrate a hostile environment and be used offensively to fire upon the enemy if required. This vehicle may alternatively be used to defensively hold a position at a location under attack then be utilized as a rescue vehicle to perform a rescue while under weapon fire, where it could be placed between the source of fire and the injured party to rescue the injured. The vehicle must therefore, be able to respond under any circumstance and suffer little or no damage.

In order to address the various needs of a police force with a limited budget, a production civilian vehicle having off road capabilities and meeting the requirements of several different roles simultaneously is desired. The preferred vehicle would be based on a production platform, where the services and skills to maintain the vehicle would be available "from the dealer", and the tools required to repair the vehicle would be commonly available. Modifications to the vehicle to alter the functional capabilities to support one or several roles simultaneously could then be applied. The vehicle should be street legal while being fully armored and have features for offensive and defensive roles.

SUMMARY OF THE INVENTION

The present invention is an updated vehicle which features a structurally armored vehicle with a separate fully armored compartment which is located on the rear of the vehicle and mounted behind the driver's compartment with a passthrough area between the front compartment and the rear compartment. The walls and roof are made of bulletproof material integrally joined at the edges. The height of the compartment allows for personnel to stand and provides the ability to locate a forward oriented bulletproof window and gun port in the front wall of the compartment.

Bulletproof access entry doors having enlarged bulletproof windows and gun ports are located on the rear of the bulletproof compartment.

A roof mounted hatch consists of a hinged plate with retractable integral side flaps, and when rotated to an open position the hinged plate provides a forward oriented shield. The bulletproof integral side flaps extend when opened to provide protection from lateral attack. Integral pistons act to retain the hatch in the open position. In a closed or stowed position the shields fold and retract, flush against the internal surface of the hatch, so as not to protrude in the compartment area. The hatch plate may have a bulletproof window and a gun port that are useable when the hatch is in the opened position. The hatch optionally has the side plates resting on the ceiling of the compartment when the hatch is closed and upon opening the hatch hinges joining the side plates to the hatch cover are operable such that the lower edges of the side plates remain in contact with the compartment ceiling.

Rectangular or circular horn shaped gun ports are strategically located around the periphery of the vehicle to increase firing coverage. The horn shape allows for preferably aiming a weapon at a target and deflecting incoming fire away from the vehicle. The inside of the gun port has a sliding door cover that blocks bullets from entering the compartment when closed.

An externally mounted access ladder is made of a series of U-shaped brackets, each having a knurled stepping/gripping surface. This ladder provides access from ground level to the roof mounted hatch. An added hand bracket is located on the top of the compartment.

Bulletproof windows or view ports are mounted on front, sides, and rear of compartment. Glare reducing materials may be applied to or embedded in the glass.

Externally mounted fixed or retractable grab rails are located on driver compartment doors and on the sides of the rear compartment. The grab rails are located above the running board area so personnel can securely ride on the outside of the vehicle.

Interior grab rails are installed for stability of internal passengers when crossing difficult terrain.

Interior lighting fixtures are mounted in specific locations in order to restrict visibility into the rear compartment. Regular and low output light sources are used in the fixtures.

Air conditioner/heater duct modifications are defined to direct air supply from the front drivers compartment to rear utility compartment.

An externally mounted vertically oriented door opening actuator is utilized which allows a push or pull movement to open the interior compartment. A rear compartment door lock restricts access to the rear compartment.

The rear compartment is insulated and padded with sound deadening material to reduce noise generated by bullet or explosive impact.

DETAILED DESCRIPTION OF THE PREFERRED EMBODIMENT

Figure 1:
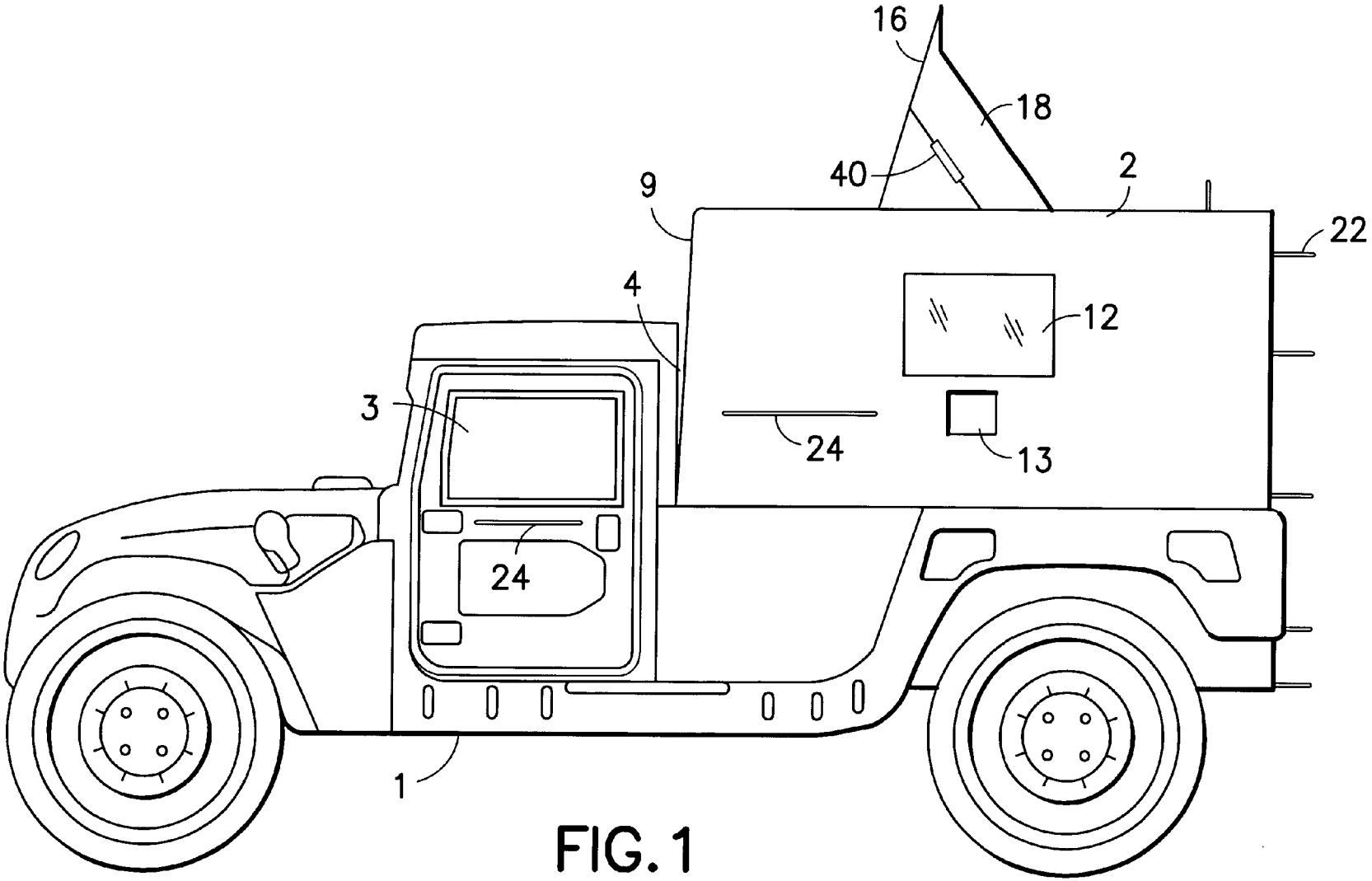
FIG. 1 is a side view of the preferred embodiment of the present invention.

The armored vehicle of the present is configured by modifying a production vehicle as shown in FIG. 1 to increase its protective capabilities and to extend the functional aspects of the vehicle to perform in multiple capacities. The vehicle is outfitted with a rear compartment 2 sufficient in size to support the varied support roles required, and having defensive, offensive and rescue oriented features integrated into the vehicle.

This invention is based on taking a sport utility vehicle 1, (SUV) such as the Hummer, then adding modifications necessary to allow it to go into a hostile environment and act as an assault vehicle, a personnel carrier, and a personnel rescue vehicle.

The rear compartment 2 is added to the base vehicle 1 that preferably has a separate driver's compartment, such as might be provided in the Hummer or a four wheel drive pickup truck. The Hummer is especially well suited for use since it provides a foundation vehicle readily adaptable to function as described in the present invention. In the preferred embodiment, the complete vehicle is armor protected, where the protection comprises the replacement of all windows with bulletproof glass, all structure of the vehicle is disassembled and reinforced using thickened panels and all systems are upgraded to be bomb or explosion proof. The base vehicle is then reassembled to look like a conventional production vehicle.

Figure 5:
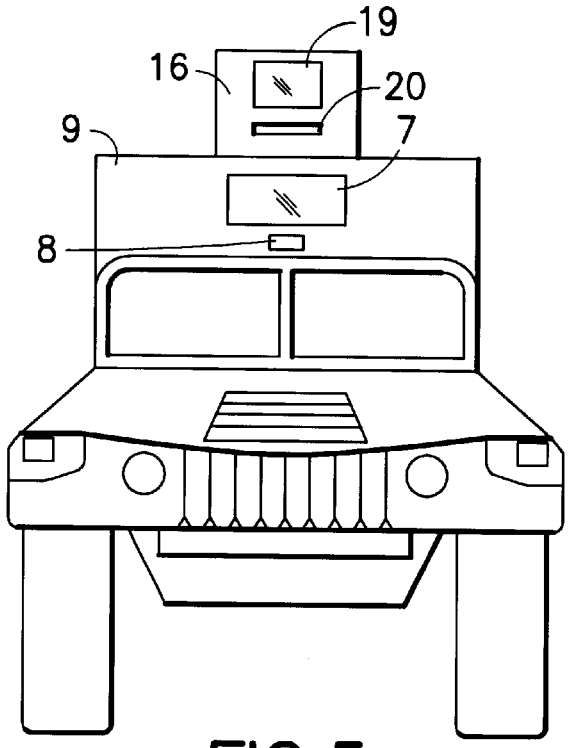
FIG. 5 is a front view of the preferred embodiment of the vehicle.

The rear compartment 2 is mounted behind the driver's front compartment 3 with a passthrough area 4 between the front compartment 3 and the rear compartment 2. The passthrough area 4 would be of sufficient size to allow rifles and other large items to fit through the passthrough area 4 opening. The passthrough area may be open at all times or it may have a locking panel that can be secured from the driver's side or from the compartment side. The walls 5 and roof 6 of the rear compartment 2 are made of bulletproof material integrally joined at the edges by a welding process, but other means of joining the walls 5 and roof 6 may be utilized. The bulletproof material has a thickness to withstand explosions and bullet fire. The height of the rear compartment 2 allows for personnel to stand and provides the ability to locate a forward oriented bulletproof window 7 and gun port 8 in the front wall 9, as shown in FIG. 5, which rises above the drivers front compartment 3. This would be useful when in offensive situations where forward visibility or gunfire is required. The floor plan of the rear compartment 2 allows up to eight people sitting or as many as twenty to thirty standing.

Figure 2:
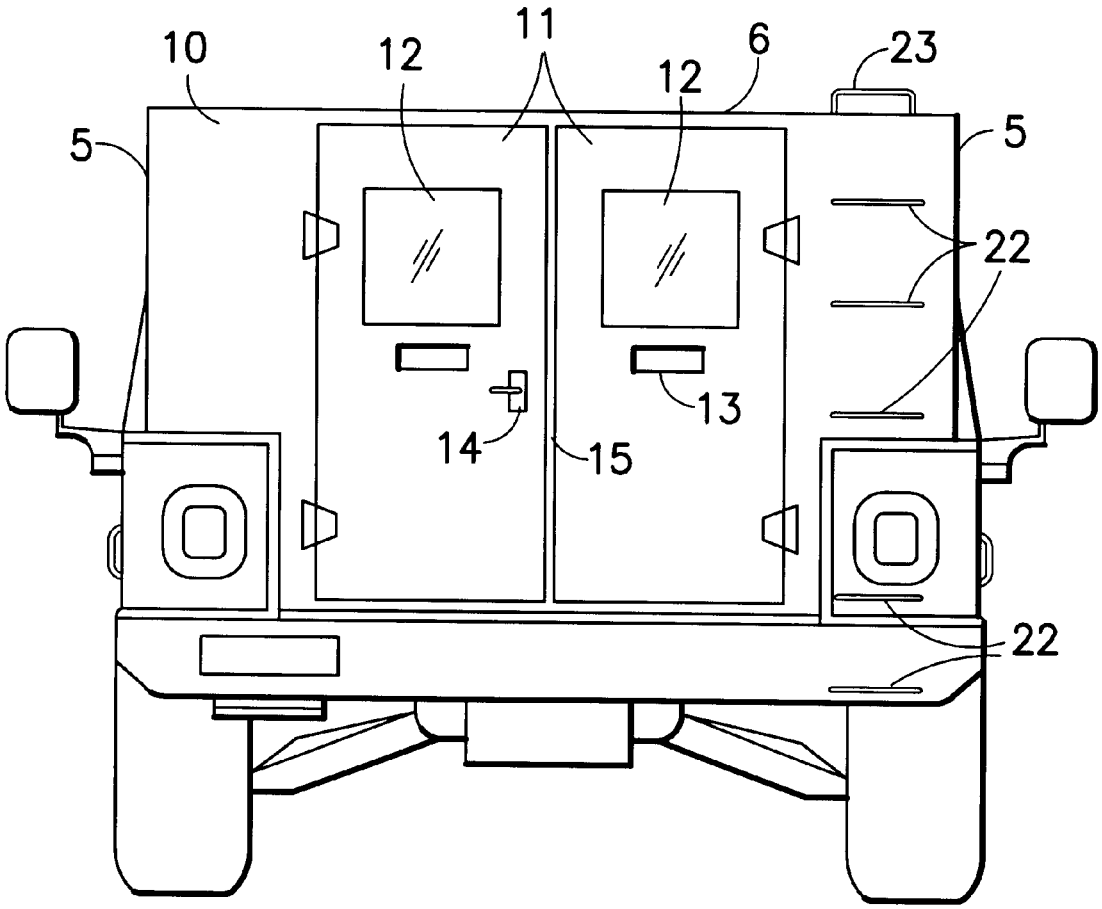
FIG. 2 is a rear view of the preferred embodiment of the vehicle and rear compartment.

Bulletproof access entry doors 11, shown on FIG. 2, are located on the rear wall 10 and have bulletproof windows 12. The hinged access entry doors 11 allow large objects or stretchers to be passed through. One of the access entry doors 11 has an overlapping panel 15 that covers the gap between the doors 11 when closed. Gun ports 13 are mounted on the doors 11 and rear wall for rearward shooting.

Figure 3:
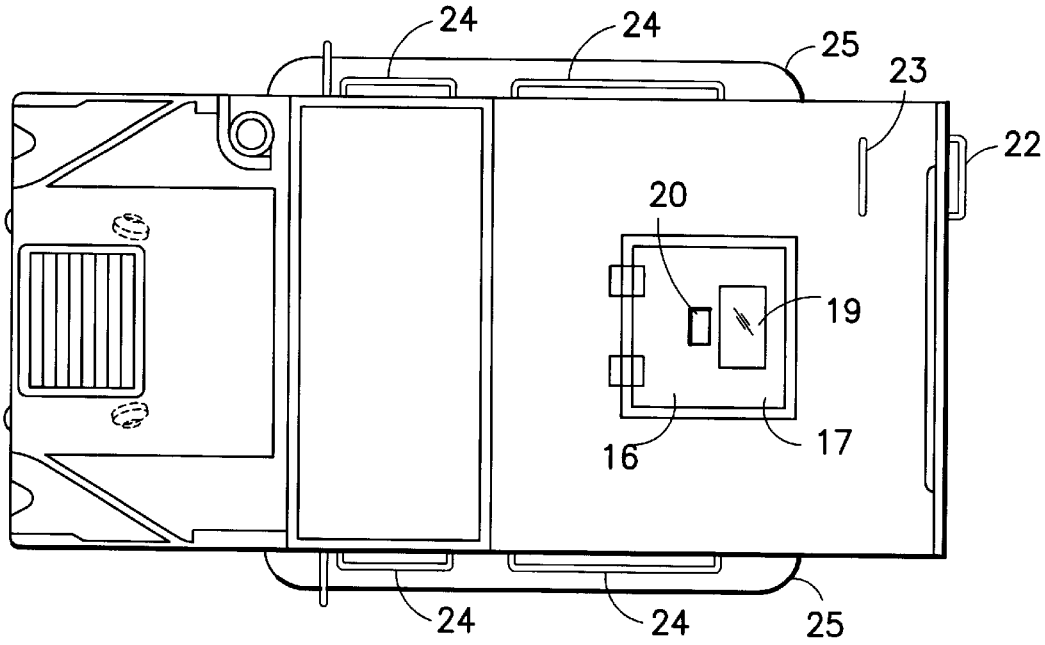
FIG. 3 is top view of the preferred embodiment of the vehicle.
Figure 6:
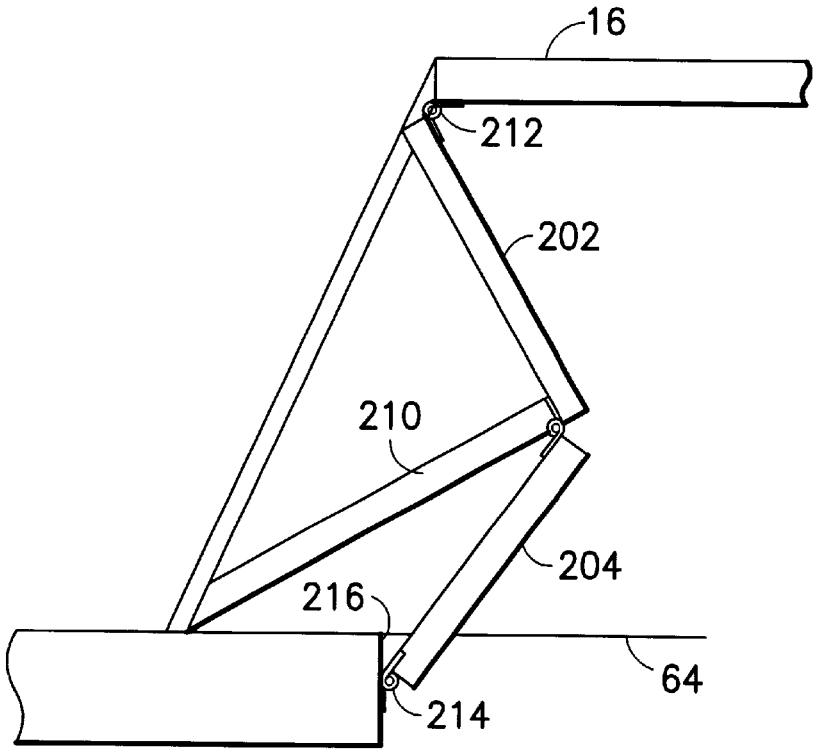
FIG. 6 is a diagram of the hatch operation with split side protector plates.
Figure 7:
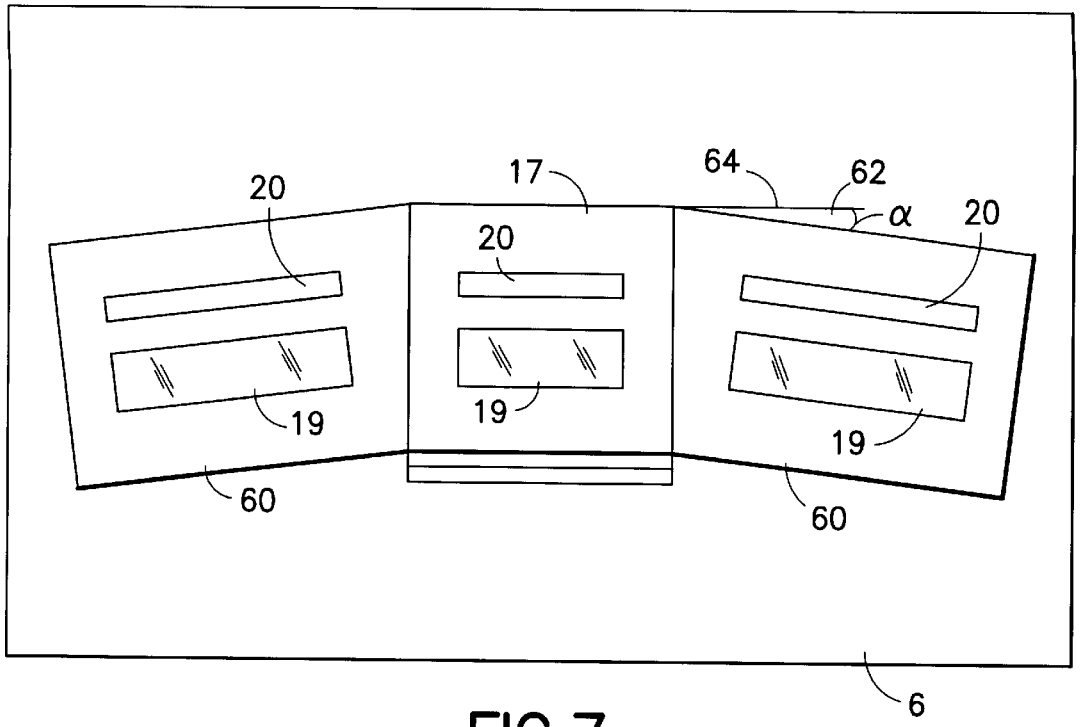
FIG. 7 is a top view of the roof showing a side panel configuration when the hatch is closed.

A roof mounted hatch 16, as shown in FIG. 1 and FIG. 3, consists of a hinged cover plate 17 which rotates up to provide a forward oriented shield, with retractable integral side protective panels 18. An officer of the law may stand behind this protective hatch 16 when the hatch is in an open position to be protected from frontal assault. The hatch 16 has side protectors or flaps 18 made of bulletproof material that extend when opened to provide protection from lateral attack. In one embodiment, the shape of the hatch side panels 18 are as shown in FIG. 1, but other versions may additionally be used as described below that provide greater lateral protection when the hatch is raised. A split panel (see FIG. 6) may be used in one embodiment where the side panel has a hinge 210 located between the upper side panel 202, and the lower side panel 204. Another hinge 212 is located between the hinged cover plate 17 and the upper side panel 202. Another hinge is located between the lower panel 204 and a wall of the roof 216. Preferably the hinges are recessed and are made of a hardened material that will not easily break. Covers may be applied to hinges to protect them from explosive forces. Integral hydraulic pistons 40 are mounted on either side of the hatch 16 to assist in opening and closing, and can support the hatch 16 in the opened position. The piston 40 is shown on the outside of the FIG. 1 but it is preferably located behind the side protectors 18. Other embodiments may use other springs, linkages or hydraulic means to assist in opening the hatch. A locking mechanism may additionally be employed to retain the hatch in the opened position. In a closed or stowed position the side flaps 202, 204 fold and retract, flush against the internal surface of the hatch 16 so as not to protrude in the compartment area 2. The hinged plate 17 of the hatch 16 may optionally have a bulletproof window 19 and a gun port 20 that provide visibility and are useable when the hatch 16 is in the opened position. The hatch may also be locked in the closed position, from the inside of the utility compartment. A control located in the driver's compartment may additionally control the operation of all hatch and door locks in the rear compartment, such that the rear compartment may be used to transfer hostile individuals.

Figure 8:
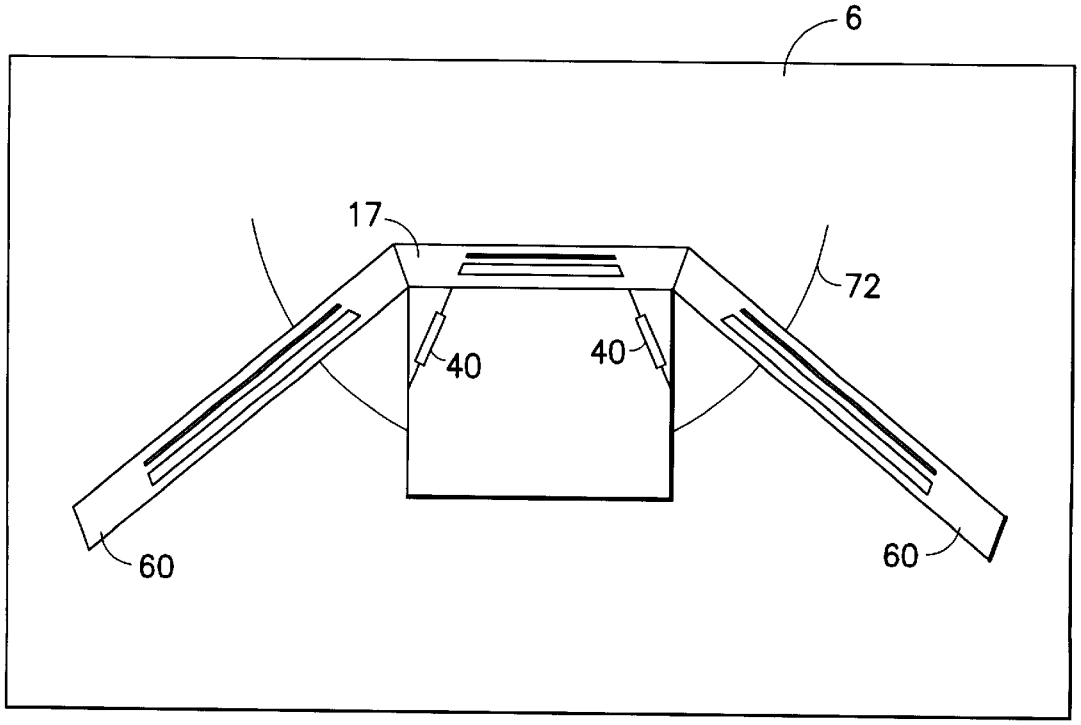
FIG. 8 is a top view of the roof and hatch when the hatch is partially opened.
Figure 9:
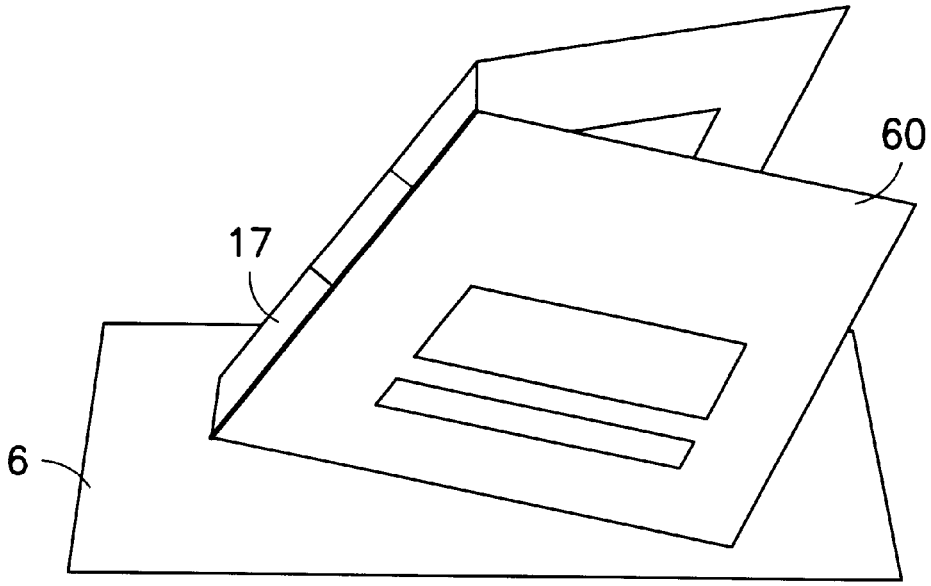
FIG. 9 is a side view looking down on the hatch and roof of the compartment when the hatch is partially opened.
Figure 10:
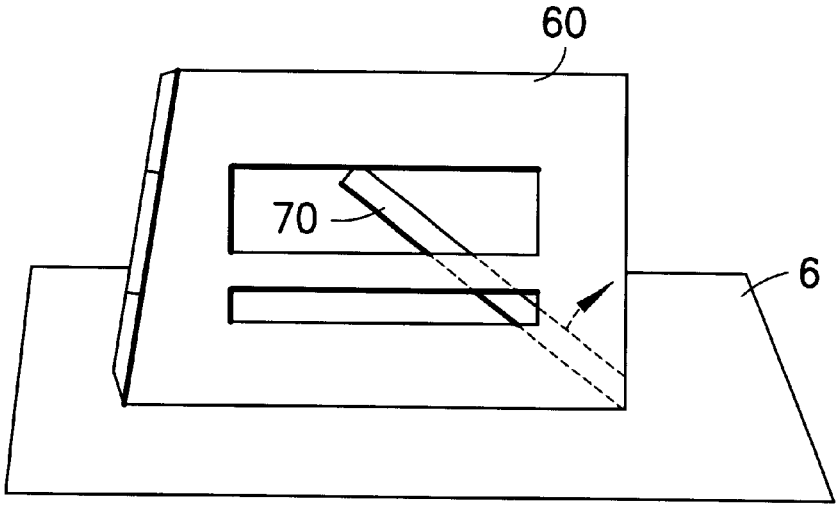
FIG. 10 is a side view looking down on the hatch with the hatch in an open condition.

The hatch may alternatively have hinged side protector panels 60 (see FIG. 8) attached to the hinged cover sides where the side panels 60 are mounted such that a portion of the side panel remains in slidable contact with the roof 6 of the compartment as the hatch 16 is opened or closed. The side panels 60 are preferably shaped such that an angle 62 exists on the contact edge of the side panel relative to the hinge line 64 of the hatch attached to the roof, the weight of the side panels causes the side panels 60 to remain in contact with the roof 6 as the hatch is opened (see FIGS. 8–12). A track 72 may be provided on the roof 6 with a pivoting follower attached to the contact edge of the side panel such that the follower interacts with the track to control the motion of the side panels 60. Alternatively, a mechanical linkage may be provided such that the change in orientation of the hatch cover directly controls the position of the side protectors such that the side panels 60 remain in close proximity to the roof of the compartment. The lower contact edge of the side panel 60 may have rounded over lower surfaces on the contact region between the roof 6 and side panel 60 such that the rounded over edge is in contact with the roof 6 throughout the opening and closing of the hatch cover 17. FIGS. 8 and 9 show the hatch cover 17 and side panels 60 in a partially open condition. In another embodiment, a rear solid bulletproof panel 70 (see FIG. 10) may raise as the hatch cover 17 is lifted or following the full opening of the hatch 16 to provide protection from projectiles fired from behind or at an angle to the rear of the vehicle.

In another embodiment, the side panels are made of a bulletproof or ballistically impenetrable fabric that acts to impede the progress of bullets fired, the fabric may be loose fitted or may extend from a spring loaded roll in a pretensioned manner where one portion is attached to a side panel frame and the base portion is attached to either the roof or a portion of the hatch frame. The frame may be shaped in a generally similar shape to the side panel 60. A loose fitted fabric would slow the projectile as it is engaged in the fabric significantly reducing its damaging impact. A rear fabric panel may be provided that is supported by a frame which may be independently operable or may work cooperatively with the hatch and side panels to rise as the hatch is opened.

Figure 11:
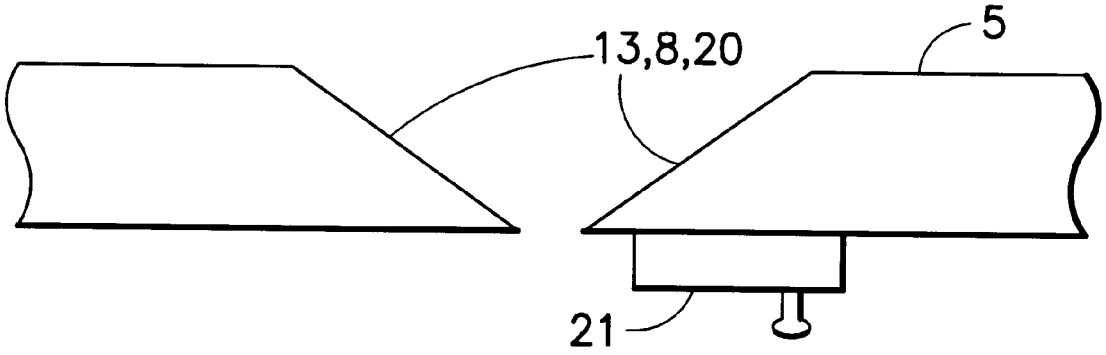
FIG. 11 is a cross sectional view of a gun port.
Figure 12:
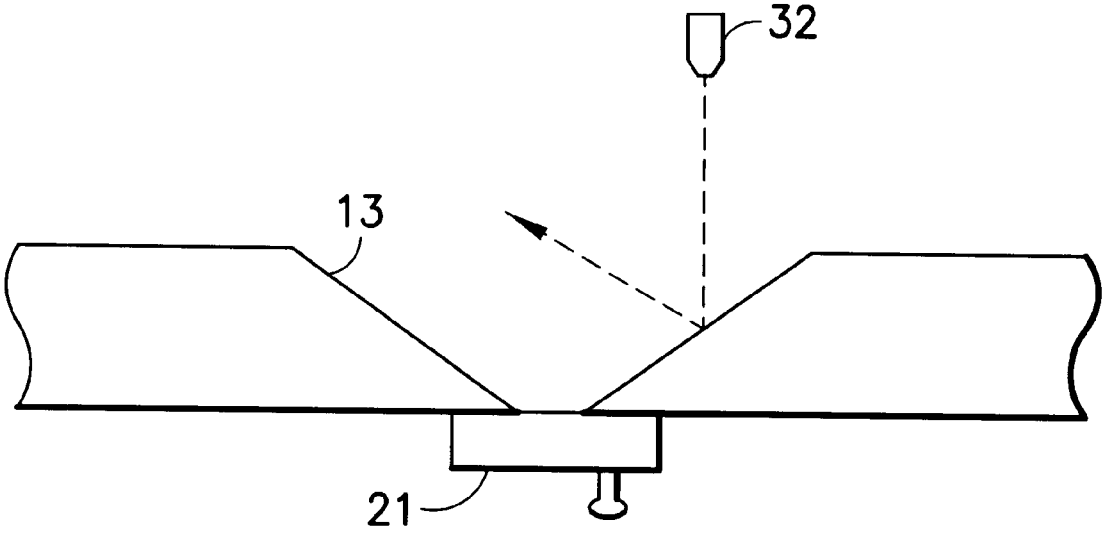
FIG. 12 is a cross sectional view of a projectile interacting with the gun port of the present invention.

The gun ports 13 as shown in FIGS. 11, 12 are strategically located around the periphery of the compartment and are preferably shaped like a horn speaker. The gun port may have either a rectangular shape or a circular shape. The horn shape allows for preferably aiming a weapon at a target. The shape allows the gun to be directed in any orientation and thereby increases the area protected. Bullets 32 hitting the gun port 13 are deflected away as shown in FIG. 12. The interior portion of the gun port 13 has a sliding bulletproof gun port cover 21 and can be set to the opened or closed position. The sliding cover 21 blocks bullet 32 entry when in the closed position. A seal may be provided on the cover to prevent entry of gas such as tear gas into the compartment. Optionally the gun ports may have straight edges where the edges are perpendicular to the exterior compartment wall on which it is mounted. In another embodiment, the horn shape may exist on the inside of the compartment where the external portion of the compartment is smooth with the exception of the opening through the compartment wall at the base of the horn which forms an aperture which may be of any shape. In this manner the exterior does not provide a clearly visible indication of the firing location of the occupants in the compartment. In the preferred embodiment, a plurality of these gun ports may be located at different heights across the walls of the compartment such that several firearms may be fired in the same general direction simultaneously.

Figure 13:
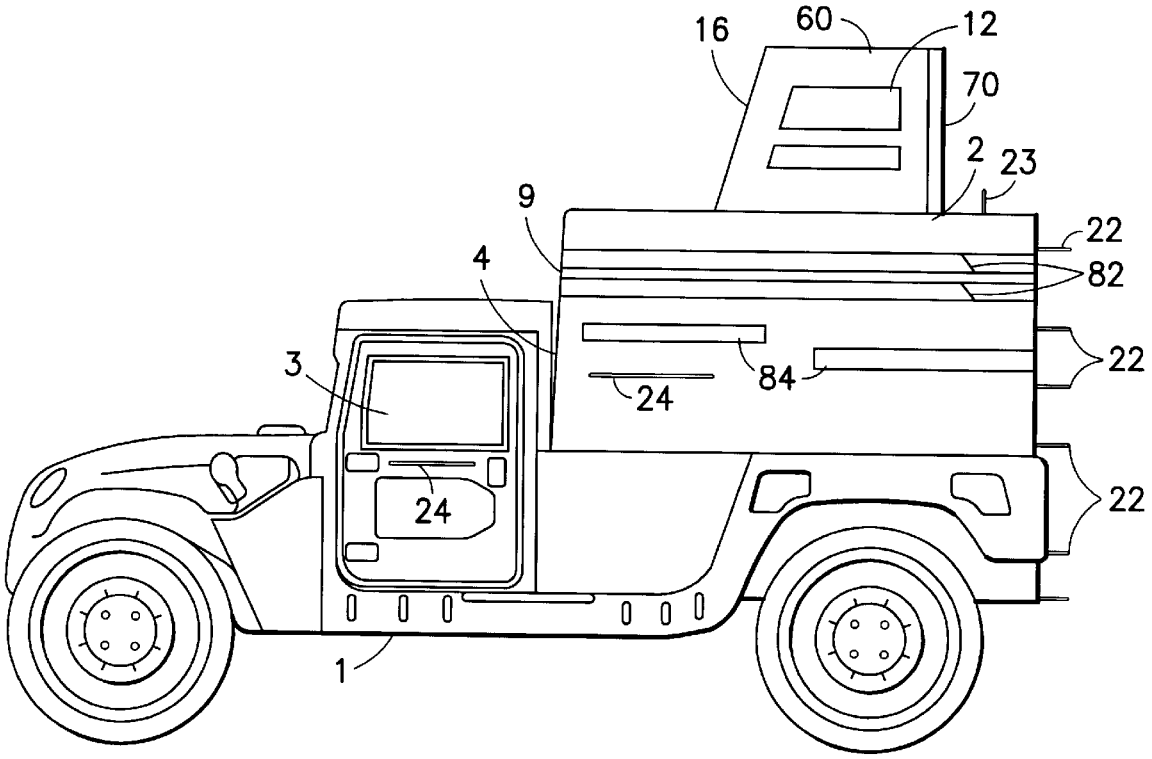
FIG. 13 is a side view of the armored vehicle of the present invention with the protective hatch opened.

While providing a means for firing from within, the externally visible horn shaped ports require the occupant to aim in an awkward manner where the firearm must pivot on the barrel. This would occur when a target moves laterally with respect to the vehicle. In an alternative embodiment, a plurality of long slot shaped ports 84 (see FIG. 13) may additionally be located in the walls of the compartment so that an occupant can track a target through a path more naturally. For example a slot may have a length equivalent to the horizontal length of the side wall portion of the compartment such that one or more individuals may use the same slot to aim and track a target. A plurality of these slotted gun ports 84 may be located on the various wall portions of the compartment of the present invention. Slotted gun ports may additionally be oriented vertically.

An externally mounted access ladder is made of a series of independent U-shaped brackets 22 (see FIGS. 2, 13) having a knurled stepping/gripping surface. The ladder provides access from ground level to the roof mounted hatch 16. Other ladder configurations may also be employed. An added bracket 23 is located on the top of the compartment and is used as a hand hold while climbing or descending. These brackets may either be permanently exposed or in another embodiment, the brackets may be retractable to inhibit access to the vehicle. The retraction of the ladder brackets 22 may be coordinated with the opening of the upper hatch 16 during adverse situations.

Bulletproof windows 12 or view ports are mounted on front, sides, and rear of the compartment 2 to provide visibility for the occupants. The view ports are preferably located above the gun ports 13 and provide a view of the area to be protected. The bulletproof glass of the view ports may be clear or tinted. The view ports may be flat or convex and are preferably rectangular in shape and may be located in specific areas of the walls. Alternatively circumferentially arranged rings 82 or bands (see FIG. 13) of transparent bulletproof material may be located in the walls as long as structural integrity is provided in the compartment sufficient to maintain the safety of the occupants of the compartment.

Externally mounted hand holds 24 or grab rails are located on the front compartment doors and side walls 5 of the rear compartment 2 for personnel to securely hold while standing on running boards 25. This increases the personnel carrying capacity of the vehicle 1. The grab rails may be permanently extended from the surface or in another embodiment, the grab rails may be retractable such that they are flush to the side of the exterior of the compartment. In the retracted state, unwanted personnel would have difficulty in securely holding onto the vehicle. The retractable grab rails 24 may additionally trap unsuspecting external personnel that try to gain access to the vehicle. In the preferred embodiment, the retraction of the grab rails 24 are controlled by the driver or the occupants of the rear compartment or driver's compartment, where the rails may be selectively engagable. Sensing means may be attached to the rails where if strain is felt by the sensing means on a particular rail, that rail may be automatically retracted to capture the hand of the person holding onto it. If vertical pressure is likewise felt by the sensing means, indicating that someone was either standing on the rail or pressing down upon the rail, the quick retraction of the rail would potentially cause the person to lose balance and become detached from the vehicle. This system may be actuated in a totally automated mode or in a semi-automatic mode or in a completely manual mode based on the presence and contact by the unwelcome person. For example, if someone outside the vehicle attempts to gain access to the vehicle, the control system may retract in response to the sensor signal, or by a user inside the vehicle that sees or hears an indication that someone is on the vehicle. Indicator lights or the like may be connected to the sensing means to indicate the location of these people. The brackets of the ladder may operate in a similar manner and may be controlled by the same control process and sensing means. The retractable brackets 22 and grab rails 24 may rotate from a usable orientation into cavities in the side of the wall surface or they may retract into cavities in line with the bracket.

The vehicle 1 is fully armored on all sides, top and undercarriage. The process uses prior art process of armor plating to achieve the high level of protection required of this vehicle. All glass, trim and internal components may be removed in order to rebuild the vehicle to the armor rating required.

Interior grab rails are installed for stability of interior passengers when crossing difficult terrain. The four-wheel drive vehicle has great mobility and offers all of the all-terrain characteristics of a production four wheel drive vehicle.

Interior mounted lighting fixtures (not shown) are located in the rear compartment 2. Different light combinations may be used to restrict viewability into the compartment 2 at night when regular lighting would alert external personnel to the activities inside the compartment. The preferred embodiment has a fixture enclosing a low intensity light utilized during stealth operations, and a standard light. The low intensity light preferably emits a red hue. Other lights or audible indicators may be used to signal occupants inside the compartment of external conditions outside the compartment or for indicating time sequenced warnings of pending events. Other colors or lighting methods may be employed that provide reduced visibility into the compartment from long range.

Air supply and routing for the conditioner/heater duct (not shown) modifications have been made to direct air from the production heating and air conditioning system into the rear compartment 2. Modifications to the system additionally provide the ability to provide compressed air to the occupants in case of potentially lethal external air conditions. The system may be manually switched, or may be automatically enabled under control of sensors. The exhaust of interior air to the exterior of the vehicle may also be protected such that air may not enter through the air exhaust system of the vehicle. In the preferred embodiment, compressed air canisters may be located under the vehicle or in secured utility areas of the vehicle.

An externally mounted vertically oriented door opening actuator/handle (not shown) has been configured to allow a push or pull on the handle to open the rear compartment 2 from the inside. Since the occupants of the rear compartment need to exit rapidly with their hands typically holding weapons, the doors may be optionally configured to operate automatically under control of a sensor or command sequence in addition to being manually operable. Locking methods may be used in the doors to prevent access to the compartment 2. An internal locking mechanism may use proximity sensors in conjunction with a occupant carried wireless key device to open the doors upon approach in addition to prior art locking mechanisms mounted inside and, or outside the compartment.

The rear compartment 2 interior is insulated and padded with sound deadening material to reduce noise generated by bullet or explosive impact. The insulating material is covered with a material such as vinyl covering for ease of cleaning.

Figure 4:
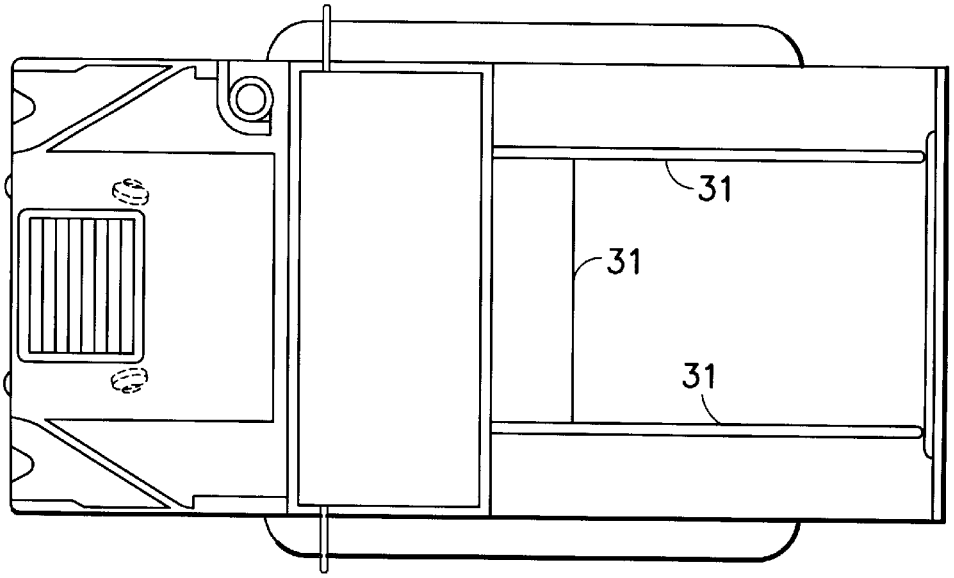
FIG. 4 is a section view of the preferred embodiment of the vehicle showing the interior of the rear compartment.

The interior of the compartment 2 may be fitted with folding bench seating platforms 31 as shown in FIG. 4. The bench seating platforms may be folded down or up and secured against the interior side wall when transporting a large number of passengers or alternatively the bench seating platforms may be removed to be used as stretchers to transport incapacitated individuals.

Figure 14:
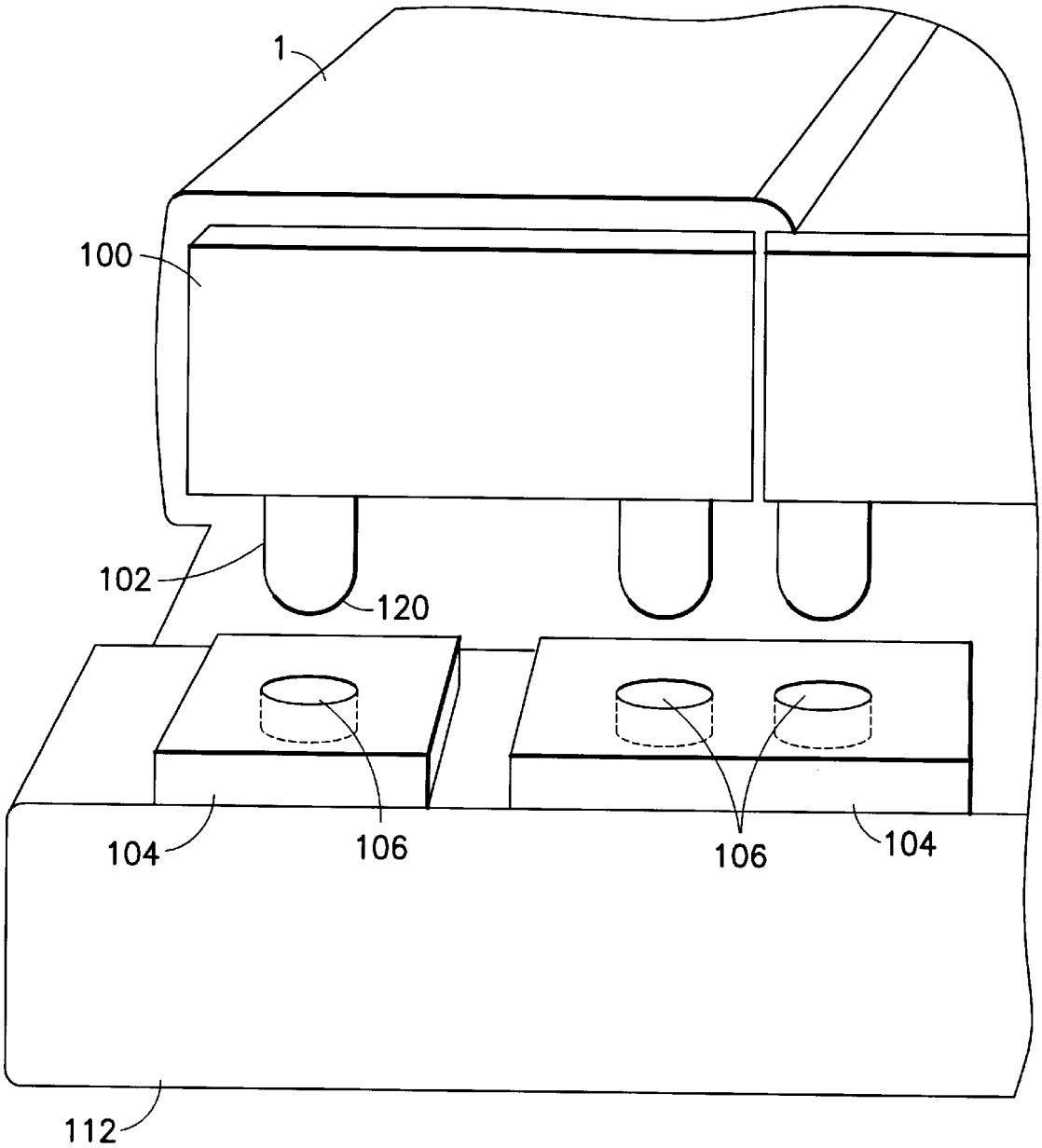
FIG. 14 is a detailed representation of the aperture surfaces showing armored panels about to be placed near the bumper.
Figure 15:
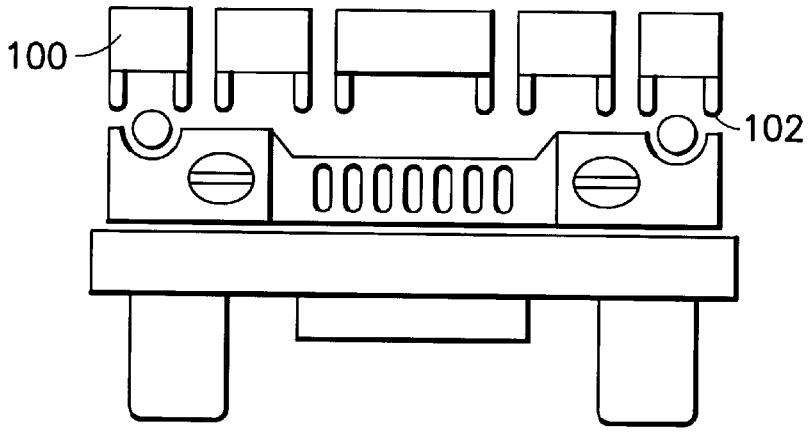
FIG. 15 is a view of the front of the vehicle with the armored plates prior to installation.
Figure 16:
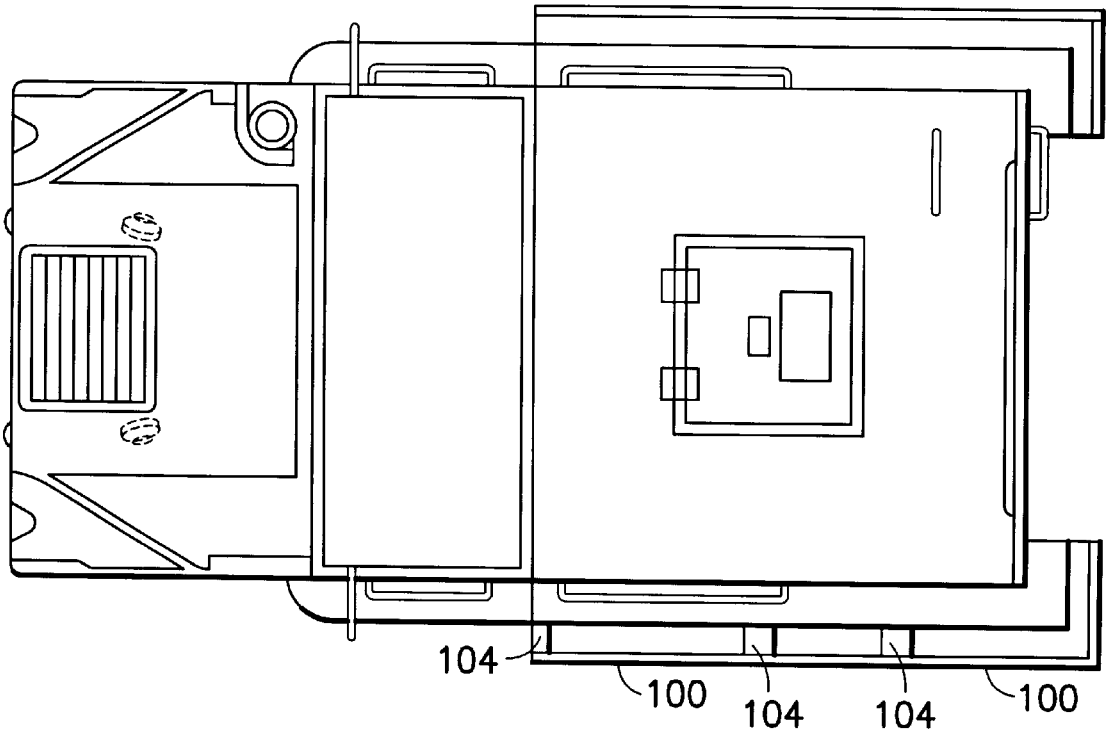
FIG. 16 is a top view of the armored vehicle of the present invention with armored plates in place around the utility compartment.

The periphery of the vehicle may be additionally fitted with a plurality of removable armored plates 100 where the armored plates 100 are located into a series of apertures 106 located around the frontal periphery of the vehicle. The removable armored plates 100 preferably have pins 102 located on the lower edges and are configured to be received into corresponding apertures 106 of aperture surfaces 104 mounted on the vehicle (see FIGS. 14, 15, 16). In one embodiment, the plates 100 protecting the engine and cooling system components are offset from the vehicle to allow for air flow to the engine and cooling systems of the vehicle. The removable armored plates 100 are placed around the vehicle such that when placed into the apertures 106 of the aperture surfaces 104, the removable armored plates 100 form a wall to provide an additional armored barrier to the vehicle. The aperture surfaces 104 located around the vehicle may be located on the bumper 112 (see FIG. 15) of the vehicle and may comprise metallic aperture surfaces 104 that are attached to the vehicle by welding to surfaces such as might be found on a brush guard that is attached to the front of the vehicle. Alternatively the aperture surfaces 104 may be mechanically fastened or mounted directly onto the vehicle (see FIG. 16). The pins 102 of the removable armored plates 100 preferably have bullet noses 120 to assist in placement of the panels where the pins slip into the apertures 106 of the aperture surfaces 104. In the preferred embodiment, the panels 100, are located substantially in a vertical or angled orientation to deflect projectiles away from the vehicle where the height of the plates do not obstruct visibility from the driver compartment 3 or the utility compartment 2. In another embodiment, the panels may optionally be made significantly higher to form a secondary wall surrounding the vehicle where the panels 100 may be mounted around the sides of the vehicle through the exterior portion of the platform surfaces (running boards) where personnel may be located between the vertical plates 100 and the exterior surface of the rear compartment (see FIG. 16). The removable plates 100 would preferably be located in close proximity to the side of the vehicle at a point beginning behind the driver's compartment 3, to form the external wall offset from the side wall of the rear compartment and then continuing to a point near the rear wall of the rear compartment, leaving an entrance to this area formed. The wheel wells may be covered to the prevent entanglement of personnel or equipment into moving wheel components.

This vehicle as specified in the preferred embodiment provides the required flexibility, capability, and capacity to work as a significant asset in a multi-function support system. The diverse roles it fulfills make it a desirable addition to a task force, swat team or rescue squad.

What is claimed is:

1. A multipurpose armored utility vehicle comprising:

a) an armored base motor vehicle;

b) an armored driver's compartment mounted on a forward portion of the armored base motor vehicle;

c) an armored utility cab mounted on a rearward portion of the armored base motor vehicle comprising:

i) a wall portion comprising:

a. a front wall portion higher than the driver's compartment;

b. a plurality of side wall portions;

c. a rear wall portion;

where the wall portion is adjoined to the armored base motor vehicle, the wall portion having an exterior surface and an interior surface;

d. a roof portion in contact with the wall portion;

ii) a plurality of sliding cover gun ports located through the wall portion, suitable for locating a barrel of a gun therethrough;

iii) a plurality of transparent view ports located through the wall portion;

iv) a hatch mounted through an aperture of the roof portion of the utility cab, the hatch comprising:

a. a hinged cover comprising a hinged edge, and a plurality of side edges, an upper surface and a lower surface;

b. a first part of a hinge attached to the hinged edge of the hinged cover; and a second part of the hinge attached to the roof portion, operable from an open to a closed position;

c. a plurality of side protectors attached to the side edges of the hinged cover;

d. means for maintaining the hatch in an open position;

e. means for maintaining the hatch in a closed position.

2. The multipurpose armored utility vehicle of claim 1 further comprising platform means extended outward from the side of the base motor vehicle.

3. The multipurpose armored utility vehicle of claim 2 further comprising a plurality of removable armored panels insertable through aperture means of a plurality of aperture surfaces fixedly mounted on the platform means of the armored utility vehicle.

4. The multipurpose armored utility vehicle of claim 2 wherein the platform means is a bumper of the armored motor vehicle.

5. The multipurpose armored utility vehicle of claim 2 wherein the removable armored panels are held in place by gravity.

6. The multipurpose armored utility vehicle of claim 2 wherein the plurality of removable armored panels are made of steel armor plate.

7. The multipurpose armored utility vehicle of claim 1 further comprising a platform receiving means mounted on a rear portion of the armored utility vehicle which is configured to accept a platform suitable for standing upon or stepping upon to gain access to the rear compartment.

8. The multipurpose armored utility vehicle of claim 1 further comprising means for lifting the hatch in an assisted manner comprising a piston configured to lift the hatch to an open position.

9. The multipurpose armored utility vehicle of claim 1 further comprising sealing means between the roof portion and the hinged cover to prevent the penetration of gasses therethrough.

10. The multipurpose armored utility vehicle of claim 1 further comprising a plurality of retractable external handholds attached to the exterior surface of the wall portion for allowing secure hand hold for externally located personnel.

11. The multipurpose armored utility vehicle of claim 10 wherein the external handholds are U-shaped brackets with gripable surfaces.

12. The multipurpose armored utility vehicle of claim 1 wherein the view ports are circumferentially located through at least the side wall portion of the wall portion.

13. The multipurpose armored utility vehicle of claim 12 wherein the circumferentially located view ports are intermittently separated by support structure.

14. The multipurpose armored utility vehicle of claim 1 wherein the side protectors of the hatch comprise a plurality of armored plates hingedly attached to the side of the hatch cover.

15. The multipurpose armored utility vehicle of claim 1 wherein the side protectors of the hatch comprise a ballistic fabric with a first edge portion attached to the side of the hatch cover and a second edge portion attached to the roof portion.

16. The multipurpose armored utility vehicle of claim 1 further comprising a hatch rear protection means operable in coordination with movement of the hatch such that it rises above the roof portion when the hatch opens.

17. The multipurpose armored utility vehicle of claim 1 further comprising a plurality of view ports are located through the hinged cover and side protectors of the hatch.

18. The multipurpose armored utility vehicle of claim 1 further comprising a plurality of gun ports located through the hinged cover and side protectors of the hatch.

* * * * *